US008778104B1

(12) United States Patent
Michienzi et al.

(10) Patent No.: US 8,778,104 B1
(45) Date of Patent: Jul. 15, 2014

(54) INSENSITIVE GUN PROPELLANT, AMMUNITION ROUND ASSEMBLY, ARMAMENT SYSTEM, AND RELATED METHODS

(75) Inventors: Christine M. Michienzi, White Plains, MD (US); Christine D. Knott, White Plains, MD (US); Brian J. Isle, Brooklyn Park, MN (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 1282 days.

(21) Appl. No.: 12/152,119

(22) Filed: Apr. 22, 2008

(51) Int. Cl.
*C06B 25/34* (2006.01)

(52) U.S. Cl.
USPC ..... 149/92

(58) Field of Classification Search
CPC ..... C06B 25/34; C06B 25/04
See application file for complete search history.

(56) References Cited

U.S. PATENT DOCUMENTS

| | | | | |
|---|---|---|---|---|
| H018 H * | 2/1986 | Bracuti et al. | ..... | 102/435 |
| 5,254,324 A | 10/1993 | Bottaro et al. | | |
| 5,565,150 A | 10/1996 | Dllehay et al. | | |
| 6,291,711 B2 | 9/2001 | Langlet | | |
| 6,508,894 B1 * | 1/2003 | Beaupre et al. | ..... | 149/19.4 |
| 6,562,160 B2 * | 5/2003 | Walsh | ..... | 149/19.7 |
| 6,764,562 B1 | 7/2004 | Persson et al. | | |
| 6,964,716 B2 | 11/2005 | Wu | | |
| 7,063,810 B1 | 6/2006 | Murphy et al. | | |
| 7,857,920 B1 * | 12/2010 | Mason | ..... | 149/19.4 |
| 2001/0042578 A1 * | 11/2001 | O'Meara et al. | ..... | 149/96 |
| 2004/0154711 A1 | 8/2004 | Sjoberg | | |

FOREIGN PATENT DOCUMENTS

| | | |
|---|---|---|
| WO | WO9849123 | 11/1998 |
| WO | WO9946202 | 9/1999 |
| WO | WO2006126927 | 11/2006 |

* cited by examiner

*Primary Examiner* — Aileen B Felton
(74) *Attorney, Agent, or Firm* — Fredric J. Zimmerman

(57) ABSTRACT

A substantially nitrocellulose-free insensitive gun propellant for barrel-type weapons is provided. The gun propellant includes at least one nitramine, such as HMX and/or RDX, a second energetic, and an inert binder system. The gun propellant is capable of producing a maximum projectile velocity exceeding 2680 ft/sec when fired from a 5 inch 54 caliber gun and gives a response to slow cook-off insensitive munitions testing of Type 4 or higher, and a response to fragment impact insensitive munitions testing of Type 3 or higher as measured by STANAG 4382 and STANAG 4496, respectively. Also provided is an ammunition round assembly, and an armament system.

7 Claims, 2 Drawing Sheets

INSENSITIVE GUN PROPELLANT, AMMUNITION ROUND ASSEMBLY, ARMAMENT SYSTEM, AND RELATED METHODS

STATEMENT REGARDING FEDERALLY SPONSORED RESEARCH OR DEVELOPMENT

The invention described herein may be manufactured and used by or for the Government of the United States of America for Governmental purposes without the payment of any royalties thereon or therefore.

FIELD OF THE INVENTION

The invention relates to gun propellants, particularly for large caliber guns, and related methods. The invention further relates to ammunition round assemblies and armament systems, as well as to methods of making and using the same.

BACKGROUND OF THE INVENTION

A gun propellant widely used in the western world, including in the United States, is typically constituted of 91 weight percent of nitrocellulose (12.0% N), 1 weight percent of ethyl centralite, 3 weight percent of butyl stearate, 1 weight percent of basic lead carbonate, 1 weight percent of potassium sulfate and 3 weight percent of total volatiles. The military often refers to the gun propellant as BS-NACO.

BS-NACO has been viewed favorably because it is clean burning and cool without requiring the inclusion of soot-producing coolants. BS-NACO, however, has less than desired insensitive munitions (IM) characteristics, i.e., sensitivity to factors that might cause an accidental detonation of the munitions. For example, BS-NACO has a greater sensitivity to slow cook-off and fragment and bullet impact insensitive munitions testing than is desired. For these reasons, certain charges containing BS-NACO propellant are not IM compliant with current military requirements, and currently require an IM waiver to enable their in-service use. While these waivers are acceptable for the short term, ultimately an IM compliant replacement propellant will be needed, particularly in larger gun systems, such as, the US Navy's 5-inch systems and the new "Advanced Gun System" 155 mm guns.

In the past, to make propellants more insensitive, energetics were replaced with inert fillers. However, the substitution of inert fillers for energetics reduces the system energy and therefore impairs performance.

SUMMARY OF THE INVENTION

In accordance with the purposes of the invention as embodied and broadly described herein, a first aspect of the invention provides a gun propellant for barrel-type weapons, including a first energetic filler including a nitramine selected from at least one of HMX and RDX, a second energetic filler, and an inert binder system including an inert polymer and an inert plasticizer. The gun propellant is capable of producing a maximum projectile velocity exceeding 2680 ft/sec when fired from a 5 inch 54 caliber gun and produces a response to slow cook-off insensitive munitions testing of Type 4 or higher and a response to fragment impact insensitive munitions testing of Type 3 or higher as measured by STANAG 4382 and STANAG 4496, respectively.

A second aspect of the invention provides an ammunition round assembly comprising a substantially cylindrical cartridge case having a forward end and an aft end, optionally a projectile head coupled to the front end of the cartridge case, gun propellant grains loaded in the cartridge case, and a primer charge operatively associated with the gun propellant grains for igniting the gun propellant grains. The gun propellant grains comprise a first energetic filler comprising a nitramine selected from HMX and/or RDX, a second energetic filler, and an inert binder system comprising an inert polymer and an inert plasticizer. The gun propellant grains are capable of producing a maximum projectile velocity exceeding 2680 ft/sec when fired from a 5 inch 54 caliber gun and produces a response to slow cook-off insensitive munitions testing of Type 4 or higher and a response to fragment impact insensitive munitions testing of Type 3 or higher as measured by STANAG 4382 and STANAG 4496, respectively.

A third aspect of the invention provides an armament system, comprising a firing device having a breech and a barrel, and an ammunition round assembly sized to seat in the breech for firing through the barrel. The ammunition round assembly of the system comprises a substantially cylindrical cartridge case having a forward end and an aft end, optionally a projectile coupled to the front end of the cartridge case, gun propellant grains loaded in the cartridge case, and a primer charge operatively associated with the gun propellant grains for igniting the gun propellant grains. The gun propellant grains comprise a first energetic filler comprising a nitramine selected from HMX and/or RDX, a second energetic filler, and an inert binder system comprising an inert polymer and an inert plasticizer. The gun propellant grains are capable of producing a maximum projectile velocity exceeding 2680 ft/sec when fired from a 5 inch 54 caliber gun and produces a response to slow cook-off insensitive munitions testing of Type 4 or higher and a response to fragment impact insensitive munitions testing of Type 3 or higher as measured by STANAG 4382 and STANAG 4496, respectively.

A fourth aspect of the invention relates to methods for making the gun propellants, ammunition round assemblies, and armament systems of the invention.

A fifth aspect of the invention relates to a method for firing an ammunition round assembly having the inventive gun propellant from a firing device.

Additional aspects of the invention relate to gun propellants, ammunition round assemblies, armament systems, and related methods made of or involving the use of a composition comprising first energetic filler comprising a nitramine selected from the group consisting of HMX, RDX, and a combination of HMX and RDX, a second energetic filler comprising guanylurea dinitramide (GUDN), and an inert binder system comprising an inert polymer and an inert plasticizer.

Other aspects of the invention will become clear upon reading the following detailed description.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

DETAILED DESCRIPTION OF EXEMPLARY EMBODIMENTS OF THE INVENTION

Figure 1:
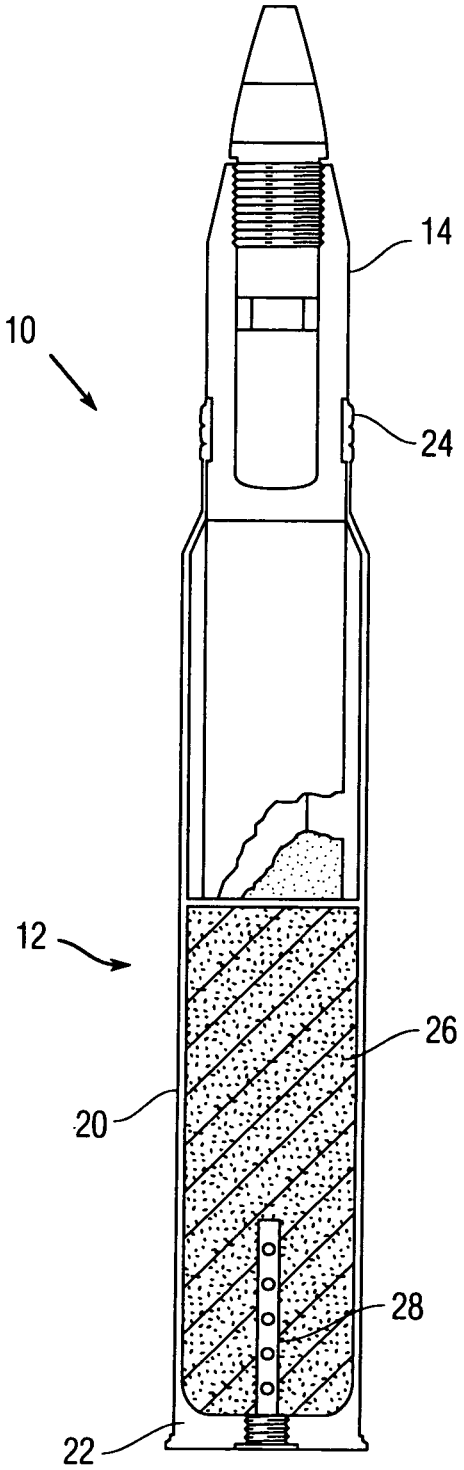
FIG. 1 is a sectioned, schematic side view of an ammunition round assembly containing a gun propellant according to an embodiment of the invention.

Reference will now be made in detail to the presently exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

The gun propellant according to an embodiment possesses a first energetic filler including one or more nitramines selected from cyclotetramethylene-tetranitramine (HMX), cyclotrimethylenetrinitramine (RDX), or a combination of HMX and RDX. The gun propellant optionally may include one or more additional nitramines. The nitramines, in an exemplary embodiment, constitute about 40 weight percent of the total weight of the gun propellant.

The embodied gun propellant further includes a second energetic filler that is not HMX and/or RDX. The second energetic filler is less sensitive than the first energetic filler but possesses excellent energetic performance. Guanylurea dinitramide, also known as GUDN and produced under the trade name FOX 12®, is, in an exemplary embodiment, a second energetic filler. The production of GUDN is described in U.S. Pat. No. 6,291,711 and U.S. Pat. No. 6,764,562, the complete disclosures of which are incorporated herein by reference. Exemplary examples of other second energetic fillers that may be used in combination with or as alternatives for GUDN are 1,1-diamino-2,2-dinitroethene, 1,3,5-triamino-2,4,6-trinitrobenzene, 3-nitro-1,2,4-triazole-5-one, bis-dinitropropyl nitrate, 2,6-diamino-3,5-dinitropyrazine-1-oxide, and combinations thereof.

The second energetic filler, e.g., GUDN, in an exemplary embodiment, constitutes about 32 weight percent of the total weight of the gun propellant. The nitramine(s), in an exemplary embodiment, constitutes a higher percentage of the total weight of the gun propellant than the second energetic filler for advantageous energy performance and IM capabilities.

The binder system of the embodied gun propellant, in an exemplary embodiment, is non-energetic, and still more particularly includes at least one non-energetic polymer, that is, an inert polymer and at least one non-energetic plasticizer, that is, an inert plasticizer. Examples of suitable non-energetic polymers are cellulose acetate butyrate (CAB) and hydroxypropyl cellulose (HPC), and combinations thereof. Examples of suitable non-energetic plasticizers are alkyl citrates, such as triethyl citrate, acetyl triethyl citrate, and tributyl citrate, and triacetin. Multiple polymers and plasticizers may be used. Additionally, polymers and plasticizers other than those mentioned herein may be used.

The gun propellant optionally further includes additional ingredients, such as extrusion aids and lubricant for improving the flowability of the formulation during processing, stabilizers, etc. Exemplary extrusion aids are Vestenamer 8012® and Vestenamer® 6213 reactive modifiers. An exemplary stabilizer is ethyl centralite.

Depending upon the desired application, the gun propellant optionally may include a de-coppering agent. Most guns have a barrel coated with a hard facing material, such as chromium, to minimize erosive wear on the barrel. Projectiles fired through the barrels sometimes include copper obturators shaped as bands for imparting a stabilizing spin to the expelled projectile. The diameter of the obturators is slightly greater than the internal bore diameter of the gun barrel, causing copper to deposit on the gun barrel as the projectile is fired. This copper deposition, referred to as "copper fouling", can affect the ballistics of the projectile and major fouling can prevent the projectile from being inserted and seated properly in the barrel. The de-coppering agent removes the copper without damaging the gun barrel or the rifling. Lead compounds such as lead carbonate are known de-coppering agents, but have high toxicity. Lead-free de-coppering agents such as bismuth oxide may be used.

Another optional ingredient is a flash suppressant designed to reduce illumination at the gun muzzle generated by a reaction between expanding gases of a burning propellant emerging from a gun barrel. A suitable flash suppressant is potassium sulfate.

According to an exemplary embodiment of the invention suited for use with 155 mm gun systems, the propellant composition includes about 40 weight percent nitramine, about 32 weight percent second energetic filler (e.g., GUDN), about 20 weight percent polymer binder, about 7 weight percent plasticizer, and about 1 weight percent processing aid.

According to an exemplary embodiment of the invention suited for use with 5 inch gun systems, the propellant composition includes about 40 weight percent nitramine, about 32 weight percent second energetic filler (e.g., GUDN), about 18 percent polymer binder, about 7 weight percent plasticizer, about 1 weight percent processing aid, about 1 weight percent flash suppressant, and about 1 weight percent de-coppering agent.

According to another exemplary embodiment of the invention suited for use with 5 inch gun systems, the propellant composition includes about 40 weight percent nitramine, about 32 weight percent second energetic filler (e.g., GUDN), about 23 percent polymer binder, about 3 weight percent plasticizer, about 1 weight percent processing aid, about 1 weight percent flash suppressant, and about 1 weight percent de-coppering agent.

The gun propellants embodied herein are, in an exemplary embodiment, prepared using known mixing and extrusion methods generally practiced in the propellant arts.

The gun propellants embodied herein are, in an exemplary embodiment, suited for large caliber gun systems, i.e., gun systems having a diameter greater than 100 mm. FIG. 1 is a schematic side view of an ammunition round assembly 10 suitable for high caliber barrel-type armaments. Ammunition round assembly 10 includes a propulsion unit 12 and a projectile head 14. Propulsion unit 12 includes a generally cylindrical cartridge case 20, which may be composed of, for example, brass or steel. Cartridge case 20 includes an aft end closure 22 and a forward end 24 and opposite ends of cartridge case 20. It should be understood that forward end 24 may possess, for example, a plug to seal the forward end of the case. In this alternative embodiment, projectile head 14 would be loaded into the gun barrel separately from the propelling charge.

Cartridge case 20 defines a chamber filled with propellant grains 26. It should be understood that propellant grains 26 may be embodied, for example, as a solid grain, powder, pellets, or other structures. Propellant grain 26 may include a plurality of different propellant compositions. Propulsion unit 12 further includes a primer charge 28 located in cartridge case 20. For example, primer charge 28 may be located in a tube extending centrally along cartridge case 20.

Figure 2:
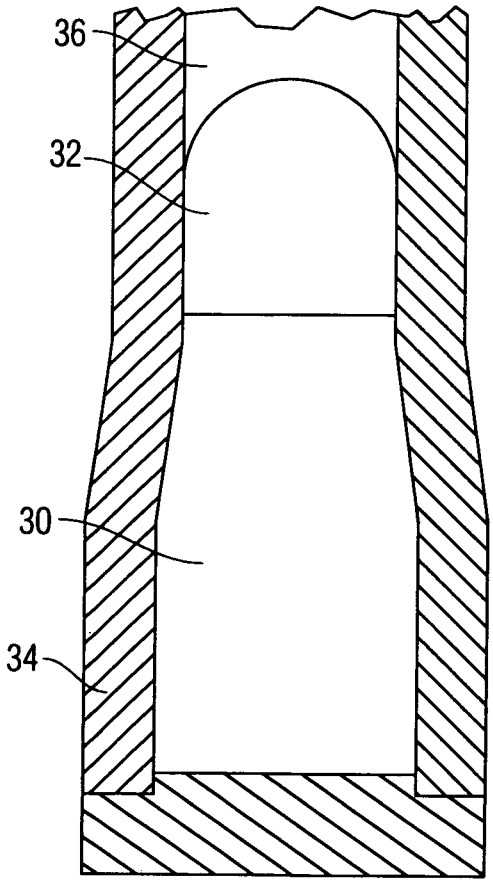
FIG. 2 is a cross-sectional view of a firing device, e.g., gun, having a breech loaded with an ammunition round assembly according to another embodiment of the invention.

FIG. 2 depicts a firing device 34, such as a gun having a barrel 36, in cross-sectional view. An ammunition round assembly 30 is loaded in the breach of firing device 34, with the projectile head 32 extending into barrel 36. It should be understood that the gun propellant embodied herein may be used in the ammunition round assemblies 10 of FIG. 1 and similar element 30 of FIG. 2, as well as ammunition rounds having alternatively designs and constructions not illustrated in the accompanying drawings.

The gun propellant, in an exemplary embodiment, is capable of producing a maximum projectile velocity exceeding 2680 ft/sec when fired from a 5 inch 54 caliber gun and gives a response to slow cook-off insensitive munitions testing of Type 4 or higher (i.e., Type 4, Type 5, or no reaction) as measured by the 2001 NATO Standardization Agency (NSA) Standardization Agreement (STANAG) 4382. The gun propellant, in an exemplary embodiment, also provides a response to fragment impact insensitive munitions testing of Type 3 or higher (i.e., Type 3, Type 4, Type 5, or no reaction) as measured by the Dec. 13, 2006 STANAG 4496. Type 1 through 5 responses are described as follows:

Type I Response—Detonation

The most violent type of explosive event. A supersonic decomposition reaction (detonation) propagates through the energetic material to produce an intense shock in the surrounding medium (e.g., air or water) and a very rapid plastic deformation of metallic cases followed by extensive fragmentation. All energetic materials will be consumed. The effects will include large ground craters for munitions on or close to the ground, perforation, plastic deformation or fragmentation of adjacent metal plates, and blast overpressure damage to nearby structures.

Type II Response—Partial Detonation

The second most violent type of explosive event. Some but not all of the energetic material reacts as in a Type I Response. An intense shock occurs; a part of the case is broken into small fragments; a ground crater can be produced, the adjacent metal plates can be damaged as in a Type I Response and there will be blast overpressure damage to nearby structures. A Type II Response can also produce large case fragments as in a violent pressure rupture (brittle fracture).

Type III Response

The third most violent type of explosive event. Ignition and rapid burning of the confined energetic material build up high local pressures leading to violent pressure rupture of the confining structure. Metal cases are fragmented (brittle fracture) into large pieces that are often thrown long distances. The unreacted and/or burning energetic material is also scattered about. Air shocks are produced that can cause damage to nearby structures. Fire and smoke hazards will exist. The blast and high velocity fragments can cause minor ground craters and damage (breaking-up, tearing, gouging) to adjacent metal plates. Blast pressure is lower than Type I or II Responses.

Type IV Response—Deflagration

The fourth most violent type of explosive event. Ignition and burning of the confined energetic materials lead to non-violent pressure release as a result of a low strength case or venting through the case walls (outlet gap, initiation capsule, etc). The case may rupture but does not fragment; orifice covers may be expelled and unburnt or burning energetic material may be scattered about and spread the fire. Pressure releases may propel an unsecured test item causing an additional hazard. No blast effect or significant fragmentation damage to the surroundings, only heat and smoke damage from the burning energetic material.

Type V Response—Burning

The least violent type of explosive event. The energetic material ignites and burns non-propulsively. The case may split up non-violently; it may melt or weaken sufficiently to allow slow release of combustion gases; the case covers may be dislodged by the internal pressure. Debris stays mainly within the area of the fire. The debris is not expected to cause fatal wounds to personnel or to be a hazardous fragment beyond 15 m.

EXAMPLES

Actual

Example 1

The following formulation set forth in Table I below is particularly suited for an advance gun system 155 mm gun.

TABLE I

| Ingredient | Weight Percent |
|---|---|
| RDX | 40 |
| GUDN | 32 |
| ATEC | 7.2 |
| CAB | 14.4 |
| HPC | 5.3 |
| Vestenamer ® 6213 | 0.7 |
| Ethyl Centralite | 0.4 |

Example 2

The following formulation set forth in Table II is particularly suited for a 5 inch diameter gun.

TABLE II

| Ingredient | Weight Percent |
|---|---|
| RDX | 40 |
| GUDN | 32 |
| ATEC | 7.2 |
| CAB | 13.65 |
| HPC | 4.55 |
| Vestenamer ® 8012 | 0.7 |
| Ethyl Centralite | 0.4 |
| Potassium Sulfate | 1 |
| Bismuth Oxide | 0.5 |

Example 3

The following formulation set forth in Table III is particularly suited for a 5 inch diameter gun.

TABLE III

| Ingredient | Weight Percent |
|---|---|
| RDX | 40 |
| GUDN | 32 |
| ATEC | 2.6 |
| CAB | 5.3 |
| HPC | 17.5 |
| Vestenamer ® 8012 | 0.7 |
| Ethyl Centralite | 0.4 |
| Potassium Sulfate | 1 |
| Bismuth Oxide | 0.5 |

Propelling charges loaded with the propellant of Example 1 passed slow cook-off testing with at Type 5 reaction and propelling charges loaded with the propellant of Example 3 gave a less violent reaction to fragment impact testing than the current BS-NACO propellant used by the Navy in large caliber guns, which gives a Type 3 reaction.

TABLE IV

| | BS-NACO | Example 3 |
|---|---|---|
| Impetus (J/g) | 891 | 896 |
| Flame Temperature (K) | 2450 | 2145 |

The calculated performance of BS-NACO and Example 3 in 5"/54 caliber and 5"/62 caliber guns is set forth below in Table V.

TABLE V

| | Gun | Projectile | Chg Wt (lb) | Max Press (psi) | Max Vel. (ft/sec) | Impulse (lb-s)* |
|---|---|---|---|---|---|---|
| BS-NACO | 5"/54 | Mk64 | 21.00 | 55000 | 2685 | 9080 |
| BS-NACO | 5"/62 | Mk64 | 21.00 | 55000 | 2749 | 9219 |
| BS-NACO | 5"/54 | HIFRAG | 21.00 | 55000 | 2691 | 8968 |
| BS-NACO | 5"/62 | HIFRAG | 21.00 | 55000 | 2757 | 9108 |
| Example 3 | 5"/54 | Mk64 | 19.20 | 55000 | 2684 | 8798 |
| Example 3 | 5"/62 | Mk64 | 19.20 | 55000 | 2746 | 8933 |
| Example 3 | 5"/54 | HIFRAG | 19.20 | 55000 | 2690 | 8686 |
| Example 3 | 5"/62 | HIFRAG | 19.20 | 55000 | 2754 | 8821 |

*Impulse limit for 5"/54 = 9,900 lb-s; for 5"/62 = 14,100 lb-s.

Additional advantages and modifications will readily occur to those skilled in the art having reference to this disclosure. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A substantially nitrocellulose-free insensitive gun propellant for barrel-type weapons, comprising:

a first energetic filler comprising at least one nitramine selected from at least one of HMX, RDX, and a combination of HMX and RDX;

a second energetic filler; and an inert binder system comprising at least one inert polymer and an inert plasticizer, wherein the gun propellant produces a maximum projectile velocity, which exceeds 2680 ft/sec when fired from a 5 inch 54 caliber gun and produces a response to slow cook-off insensitive munitions testing of at least Type 4 and a response to fragment impact insensitive munitions testing of at least Type 3 as measured by STANAG 4382 and STANAG 4496, respectively, wherein the gun propellant further comprises a flash suppressant, which is potassium sulfate, wherein the gun propellant further comprises a lead-free de-coppering agent, which is bismuth oxide, and wherein the second energetic filler comprises a member selected from at least one of 1,1-diamino-2,2-dinitroethene, 1,3,5-triamino-2,4,6-trinitrobenzene, 3-nitro-1,2,4-triazole-5-one, bis-dinitropropyl nitrate, guanylurea dinitramide, and 2,6-diamino-3,5-dinitropyrazine-1-oxide.

2. The gun propellant of claim 1, wherein the gun propellant is free of nitrocellulose.

3. The gun propellant of claim 1, wherein the first energetic filler comprises RDX.

4. The gun propellant of claim 1, wherein the second energetic filler comprises guanylurea dinitramide (GUDN).

5. The gun propellant of claim 4, wherein the gun propellant is comprised of about 40 weight percent said at least one nitramine, about 32 weight percent said GUDN, about 20 weight percent said at least one inert polymer, about 7 weight percent said inert plasticizer, and about 1 weight percent processing aid.

6. The gun propellant of claim 4, wherein the gun propellant is comprised of about 40 weight percent said at least one nitramine, about 32 weight percent said GUDN, about 18 percent said at least one inert polymer, about 7 weight percent said inert plasticizer, about 1 weight percent processing aid, about 1 weight percent said flash suppressant, and about 1 weight percent said lead-free de-coppering agent.

7. The gun propellant of claim 4, wherein the gun propellant is comprised of about 40 weight percent said at least one nitramine, about 32 weight percent said GUDN, about 23 percent said at least one inert polymer, about 3 weight percent said inert plasticizer, about 1 weight percent processing aid, about 1 weight percent said flash suppressant, and about 1 weight percent said lead-free de-coppering agent.

* * * * *